US005318223A

United States Patent [19]

Gale

[11] Patent Number: 5,318,223

[45] Date of Patent: Jun. 7, 1994

[54] SEPARABLE MODULAR CONTAINER

[76] Inventor: Gregory W. Gale, 1018 Borrette La., Napa, Calif. 94558

[21] Appl. No.: 128,249

[22] Filed: Sep. 29, 1993

[51] Int. Cl.[5] ..... B65D 5/54; B65D 5/48

[52] U.S. Cl. ..... 229/120.011; 229/120.37

[58] Field of Search ..... 229/120.01, 120.011, 229/120.012, 120.37

[56] References Cited

U.S. PATENT DOCUMENTS

| | | | |
|---|---|---|---|
| 2,327,529 | 8/1943 | Kieckhefer et al. . | |
| 2,651,449 | 9/1953 | Burnett | 229/120.01 |
| 2,745,588 | 5/1956 | Dunning | 229/120.01 |
| 3,058,644 | 10/1962 | Zastrow | 229/120.01 |
| 3,135,457 | 6/1964 | Risucci . | |
| 3,252,646 | 5/1963 | Rockefeller | 229/120.011 |
| 3,540,582 | 11/1970 | Wood et al. | 229/120.012 |
| 3,892,348 | 7/1975 | Rohner | 229/120.01 |
| 4,333,569 | 6/1982 | Hammacher | 229/120.01 |
| 4,485,926 | 12/1984 | Lenzmeier | 229/120.011 |
| 4,533,052 | 8/1985 | Fruchey et al. | 229/120.011 |
| 4,778,057 | 10/1988 | Allen et al. . | |
| 4,909,433 | 3/1990 | Taylor | 229/120.011 |
| 4,919,269 | 4/1990 | Wright et al. . | |
| 5,012,929 | 5/1991 | Roosa . | |
| 5,197,660 | 3/1993 | Colling . | |

FOREIGN PATENT DOCUMENTS

| | | | |
|---|---|---|---|
| 1209490 | 1/1966 | Fed. Rep. of Germany | 229/120.011 |
| 1486322 | 1/1969 | Fed. Rep. of Germany | 229/120.011 |
| 1454527 | 11/1976 | United Kingdom | 229/120.011 |

*Primary Examiner*—Gary E. Elkins
*Attorney, Agent, or Firm*—Richard C. Litman

[57] ABSTRACT

A packaging container/case is formed of two cooperating cartons, the cartons formed of similar or identical blanks. Each carton includes a first major panel and an opposite second major panel, with a first major panel extension extending from the first major panel. The two cartons are joined by securing each first major panel extension to the second major panel of the other carton, providing unbroken major panels for the assembled case. The minor panels/ends are also unbroken. Each extended first major panel and extension includes an unbroken upper closure flap extending the length of the panel and extension, which with the minor panel closure flaps extending from the top of the opposed ends of each carton, provides conventional upper closure for the assembled case which can be sealed using standard packaging machinery. The bottom closure flaps are conventional each carton of the case, although the upper closure may be applied to the lower closure flaps if so desired. The resulting coplanar flap surfaces, with the unbroken sides of the assembled case, provide stacking and compact storage of such cases as required. Tear strips and/or score lines may be formed vertically down the center of the extended major panels and panel extensions, to provide for separation of the two cartons forming the case without need for tools. Preferably, the two cartons are equal in size and rectangular. However, the present construction may also be applied to two mating cartons of unequal size and/or congruent trapezoidal shape.

11 Claims, 3 Drawing Sheets

SEPARABLE MODULAR CONTAINER

FIELD OF THE INVENTION

The present invention relates generally to packaging, boxes and containers, and more specifically to a container which can be formed and assembled using standard automated machinery in the industry and which provides for separation into two fully sided containers after assembly. The bottom, sides and top of the entire container are flush to provide for level stacking and maximum spatial efficiency for storage before separation. The container is particularly adaptable to internal partitions for the carriage and storage of separate articles, e.g., bottles, cans, jars and the like.

BACKGROUND OF THE INVENTION

The packaging industry generally relies upon various automated machines for the production of boxes and similar containers, from cutting or punching out the blanks from sheets of material, to folding, perforating and assembling, and closing the blanks into completed containers. While such machinery can be modified to provide for non-standard containers, such modification and redesign is obviously relatively costly and adds to the cost of manufacture of such containers. Moreover, as the machinery is made more complex, the likelihood of breakdown and lost time increases.

On the other hand, the packaging industry is constantly seeking new packaging means to provide greater convenience to the user or consumer. One example is the combination of two equally sized containers into a single container, which single container may be separated into the two smaller containers to provide a convenient quantity of the goods therein for an individual. While various such containers have been developed, as will be described below, each of the heretofore known separable containers suffers from some deficiency or deficiencies, making them relatively difficult and/or costly to manufacture and/or use.

The need arises for a separable, modular container which may be manufactured using conventional machinery and which does not require significant modifications or customizing of such machinery. The container must provide for ease of stacking and limit the amount of space wasted by bulky seams and the like. Moreover, the container must provide for ease of separation into two like containers for the consumer or user, without requiring tools or altering or damaging the container and thereby destroying its utility.

DESCRIPTION OF THE PRIOR ART

U.S. Pat. No. 2,327,529 issued to Herbert M. Kiekhefer et al. on Aug. 24, 1943 discloses a Connected Container having a relatively short extension from one vertical side wall, which extension is attachable to another like container to double the size and capacity of the joined unit. The relatively short extensions require the use of mechanical fasteners (e.g., staples or the like), rather than providing sufficient surface area for adhesive fastening. Moreover, the otherwise standard boxes each include four upper closure flaps, or a total of eight upper flaps which cannot be closed by a standard automated machine; a modified packaging machine is required. Finally, the assembled box requires a tool (knife) for separation into its two base components.

U.S. Pat. No. 3,135,457 issued to Edward J. Risucci on Jun. 2, 1964 discloses a Plural Carton Containing Separable Units. The carton is formed from a single blank and includes an accordion fold between the two units of the carton, unlike the present invention, in which each container is formed from a separate blank and which containers are rigidly secured together when assembled.

U.S. Pat. No. 4,778,057 issued to E. James Allen et al. on Oct. 18, 1988 discloses a Dual Clip Tissue Carton wherein the carton is again formed from a single blank. The opposite end closures are minimal, serving only to secure relatively tightly packed or compressed articles therein, e.g., interfolded tissues. Once the carton halves have been separated, no end closure is provided for the separated ends of the two halves.

U.S. Pat. No. 4,919,269 issued to James W. Wright et al. on Apr. 24, 1990 discloses a Multiple Compartment Container formed from a single blank and including a central tear strip providing for separation into two separate units. The completed, folded carton includes discontinuous top closure flaps along at least one major side, unlike the present invention, as well as additional relatively complex folds and junctures requiring relatively complex machinery for folding and assembly.

U.S. Pat. No. 5,012,929 issued to Paul D. Roosa on May 7, 1991 discloses a Twin Tray Container primarily intended as a food container. As such, the primary point of the device is to provide against tampering by means of a single use seal. A central tear strip is provided to separate the two container halves. The multiple folds of the end closures and discontinuous closure flap along at least one edge, result in a relatively complex structure requiring non-standard packaging machinery for manufacture.

Finally, U.S. Pat. No. 5,197,660 issued to Keith J. Colling on Mar. 30, 1993 discloses a Twin Package Carton having opposed upper tabs providing for the securing of each carton to an opposite carton. This results in the two cartons being secured only along a single line operable as a hinge, thus allowing the cartons to move about the hinge line relative to one another. Handling such an assembly would require relatively great care to ensure that both portions are held securely when lifted. Alternatively, if the bottom portions of the halves are secured together (e.g., tape), then a cutting tool must be provided to separate the halves, which negates the advantage of the ease of separation of the upper attachment. If the tape is merely torn loose, then any indicia or graphics under the tape would be damaged. The present invention traverses all of these various disadvantages.

None of the above noted patents, taken either singly or in combination, are seen to disclose the specific arrangement of concepts disclosed by the present invention.

SUMMARY OF THE INVENTION

By the present invention, an improved packaging container is disclosed.

Accordingly, one of the objects of the present invention is to provide an improved container which may be formed from a single sheet of planar material as a carton, and which two such cartons may be joined together to form a case.

Another of the objects of the present invention is to provide an improved container which joined case includes four peripheral top flaps, and which may be closed using standard packaging machinery.

Yet another of the objects of the present invention is to provide an improved container which completed case provides for ease of separation into two separate cartons without use of tools for such separation.

Still another of the objects of the present invention is to provide an improved container which case and carton outer surfaces are substantially even, thereby providing for ease of stacking and storage.

A further object of the present invention is to provide an improved container which may be used as a general purpose case or cartons, and which cartons alternatively may include partitions to serve as containers for articles such as bottles, jars, and cans and the like.

An additional object of the present invention is to provide an improved container which may be constructed of a variety of materials, but which is preferably constructed of corrugated fiberboard material.

A final object of the present invention is to provide an improved container for the purposes described which is inexpensive, dependable and fully effective in accomplishing its intended purpose.

With these and other objects in view which will more readily appear as the nature of the invention is better understood, the invention consists in the novel combination and arrangement of parts hereinafter more fully described, illustrated and claimed with reference being made to the attached drawings.

BRIEF DESCRIPTION OF THE DRAWINGS

Similar reference characters denote corresponding features consistently throughout the several figures of the attached drawings.

DETAILED DESCRIPTION OF THE PREFERRED EMBODIMENT

Figure 1:
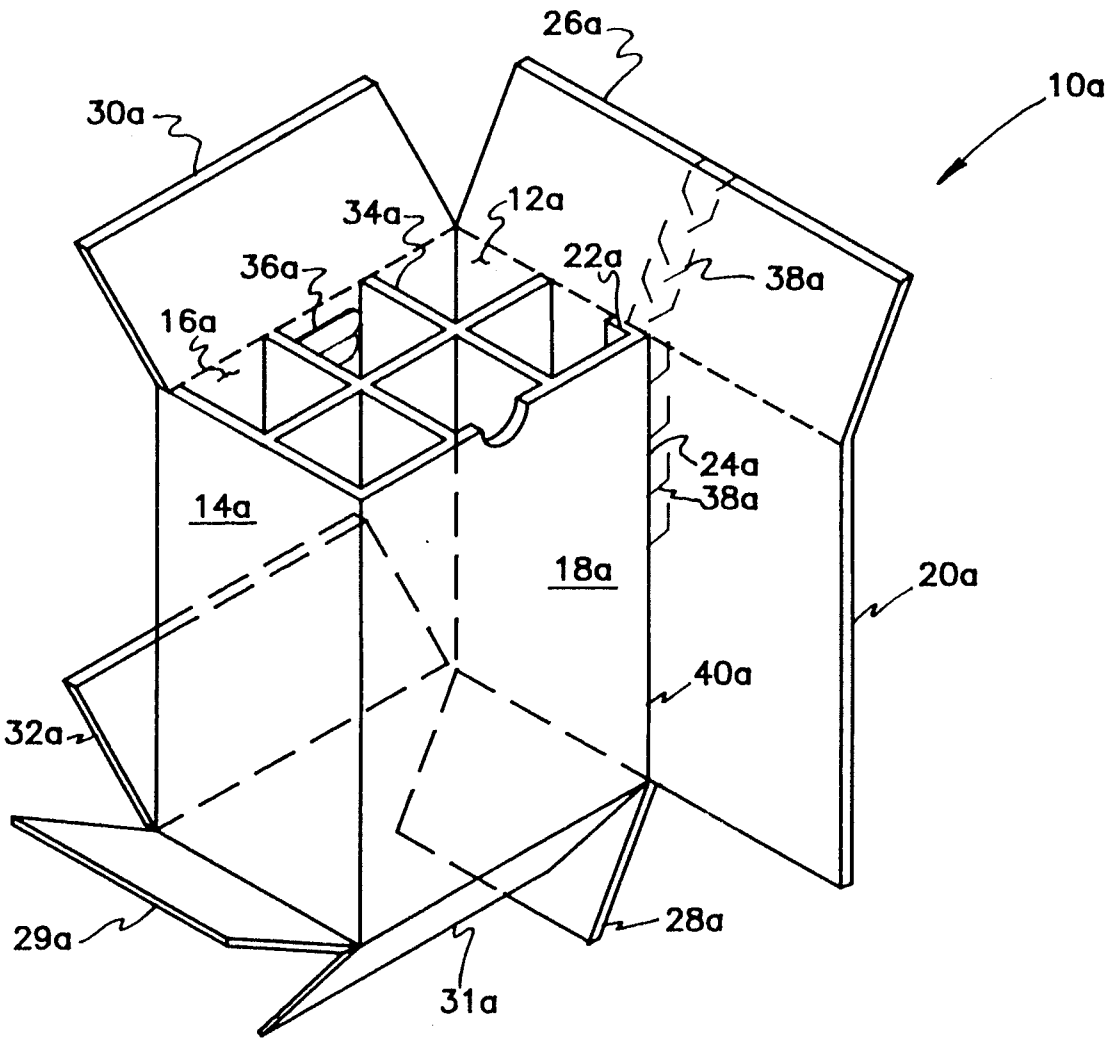
FIG. 1 is a perspective view of a first or single preassembled carton of the plural cartons forming a container case of the present invention.
Figure 2:
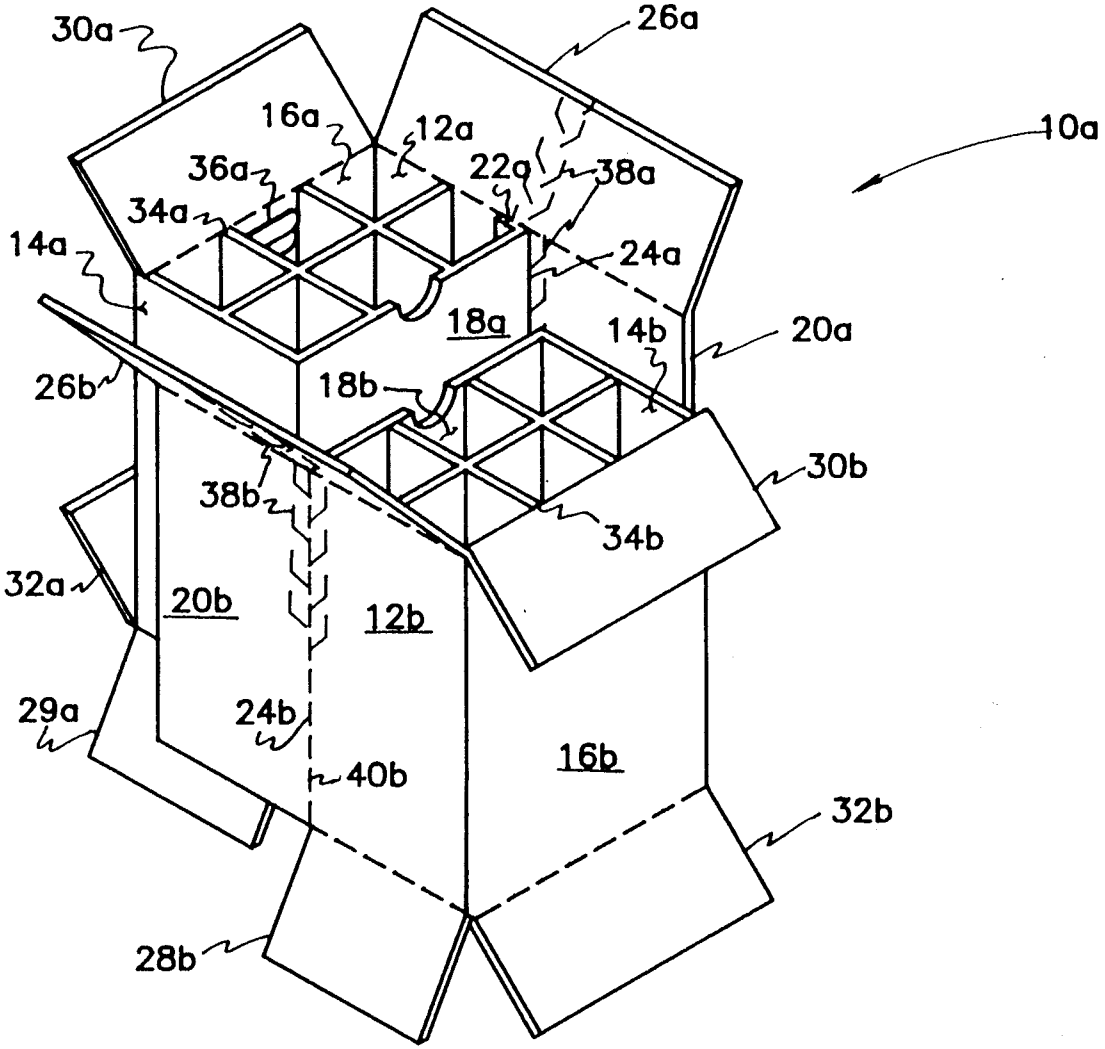
FIG. 2 is a perspective view of a first preassembled carton and identical second preassembled carton arranged in position for joining together to form a container case.
Figure 3:
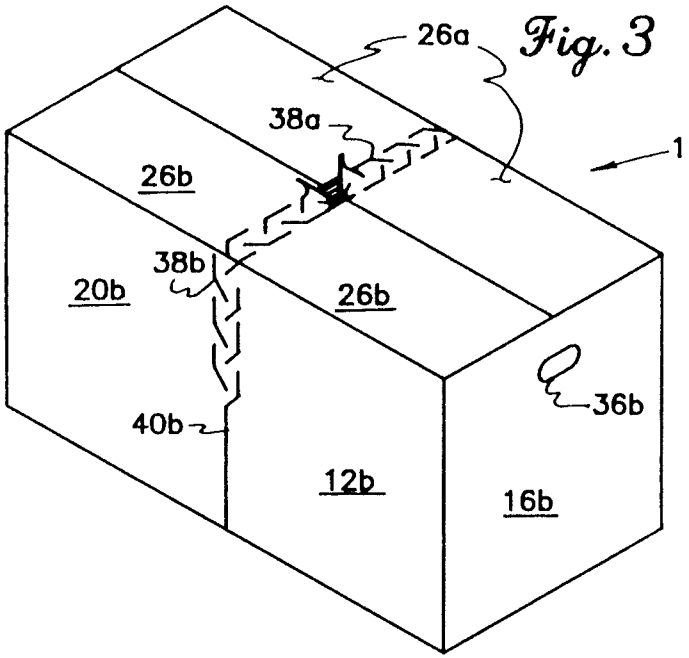
FIG. 3 is a perspective view of the case of the present invention formed by joining the two cartons of FIG. 2.

Referring now particularly to FIG. 1 of the drawings, the present invention will be seen to relate to a specialized carton 10*a*, which when joined with a similar or identical second carton 10*b*, serves to form a case 1, as shown in FIG. 3. Carton 10*a* of FIG. 1 (and 10*b* of FIG. 2) may be formed of a single planar sheet of material (e.g., fiberboard and/or corrugated fiberboard, although other sheet materials may be used) and essentially comprises opposed first and second major panels 12*a* and 14*a* and opposed first and second minor panels 16*a* and 18*a*. However, the first major panel 12*a* will be seen to include a panel extension 20*a* which provides for the attachment of carton 10*a* to a like carton 10*b*, as will be explained further below.

The four panels 12*a* through 18*a* are folded to form a generally trapezoidal or rectangular structure, with one edge of the second minor panel 18*a* having an attachment strip 22*a* (e.g., adhesive, although staples and/or other mechanical means may be used) extending therefrom and providing for the securing of the second minor panel 18*a* to the midline or juncture 24*a* of the first major panel 12*a* and its panel extension 20*a*. Thus, the four panels 12*a* through 18*a* form an open ended box-like trapezoidal or rectangular structure when assembled, with the first major panel extension 20*a* extending therefrom.

Top and bottom closure flaps are also provided on carton 10*a*, which in combination with the closure flaps of an adjoining like carton 10*b*, serve to provide full enclosure for a case 1 assembled therefrom. Carton 10*a* includes upper and lower major flaps 26*a* and 28*a*, which flaps 26*a* and 28*a* extend respectively from the upper and lower edges of the first major panel 12*a*. Major flap 26*a* will be seen to extend along the entire length of the first major panel 12*a* and panel extension 20*a*, thus extending from end to end of a case 1 formed from two cartons 10*a* and 10*b*, while the first lower major flap 28*a* extends only the length of the panel 12*a* to the juncture 24*a* between panel 12*a* and panel extension 20*a*. Additional upper and lower minor flaps 30*a* and 32*a* extend respectively from the upper and lower edges of the first minor panel 16*a*, which flaps 30*a* and 32*a* serve as end flaps for an assembled case 1. Finally, a second lower major flap 29*a* and second lower minor flap 31*a* extend respectively from the lower edges of the second major panel 14*a* and second minor panel 18*a*. Lower panels 28*a*, 29*a*, 31*a*, and 32*a* provide for standard, conventional four flap closure of the bottom of the carton 10*a*.

It will be noted that no upper flaps are provided along the second major panel 14*a*, or on the second minor panel 18*a*. This is due to the fact that the above described flaps 26*a* and 30*a*, in combination with flaps 26*b* and 30*b* of a carton 10*b*, serve to provide two major panel and two minor/end panel flaps for complete and standard upper closure of a case 1 assembled therefrom. While the present construction provides an individual lower or bottom flap for each side of each carton 10*a* and 10*b*, thus providing additional strength for the separated cartons, it will be seen that the construction of the upper flaps described above may also be applied to the lower flap construction, if desired.

Each carton 10*a* may also include a plurality of partitions 34*a*, for the orderly storage and protection of separate articles (e.g., glass containers such as bottles and jars, etc.) therein. A partition 34*a* may comprise a three by two matrix of spaces, thus providing space for e.g. a "six pack" of individual beverage containers, or another number of individual spaces as desired. Partitions 34*a* may be separately formed of additional sheets of material, or at least a portion of each partition 34*a* may be formed of an extended end (not shown) of the first and second lower major panel flaps 28*a* and 29*a*, as desired.

Each carton 10*a* may also include a hand hold 36*a* located in the upper portion of the first minor panel 16*a*, immediately below the upper minor flap 30*a*. The assembly of a carton 10*a* and 10*b* together will be seen to provide hand holds at opposite ends of the case 1, thus providing for ease of handling of a full case 1.

In addition to the above features, the first major panel 12*a* and adjoining upper major flap 26*a* are also provided with a tear strip 38*a* extending across the center of the flap 26*a* and thence downward along the juncture or midline 24*a* of the adjoining panels 12*a* and 20*a* to a point substantially halfway down the two panels. From that point downward, a score line 40*a* is provided across the remaining height of the panels 12*a* and 20*a*. With like tear strips and score lines 38*b* and 40*b* provided on the mating carton 10*b*, it will be seen that two joined cartons 10*a* and 10*b* assembled as a case 1, may be easily separated as desired.

While the callouts 10*a* through 40*a* described above are specifically applicable to the carton 10*a* of FIGS. 1 and 2, callouts 10*b* through 40*b* will be seen to apply to like features of carton 10*b* of FIG. 2; each carton 10*a* and/or 10*b* may be formed from an identical blank of flat sheet material. However, the two cartons 10*a* and 10*b* of FIG. 2 are described as such in order to describe better their mating assembly into a single case 1, below. While cartons 10*a* and 10*b* are shown as being equal in size, it will be understood that by adjusting the length of the extensions 20*a* and 20*b* relative to the second major side panels 14*a* and 14*b*, that the two cartons 10*a* and 10*b* may be formed to have unequal sizes or volumes, if desired.

The cartons 10*a* and 10*b* may be assembled into a case 1 as shown in FIG. 2. It will again be noted that carton 10*b* is identical to carton 10*a* in FIG. 2, but carton 10*b* has been turned 180 degrees in order to mate with the carton 10*a*. The lower flaps 28*a* and 28*b*, 29*a* and 29*b*, 31*a* and 31*b*, and 32*a* and 32*b* respectively of cartons 10*a* and 10*b* are first closed to provide bottom closure means for each carton 10*a* and 10*b* and a resulting case 1. The cartons 10*a* and 10*b* are then joined by securing the first major panel extension 20*a* of carton 10*a* to the adjacent and complementary second major panel 14*b* of carton 10*b*, and in a like manner securing the first major panel extension 20*b* of carton 10*b* to the adjacent and complementary second major panel 14*a* of carton 10*a*. It will be noted that the immediately adjacent second minor panels 18*a* and 18*b* are not secured together, in order to provide for the later ease of separation of the two cartons 10*a* and 10*b* as will be explained further below. While adhesive attachment means is preferably used, mechanical means (e.g., staples, etc.) may be used as desired.

The above assembly will be seen to resemble a single case with the four upper flaps 26*a*, 26*b*, 30*a* and 30*b* opened in a conventional array. Thus, a case formed from cartons 10*a* and 10*b* may be passed through a conventional box, carton or case sealing machine, and the remaining upper flaps 26*a*, 26*b*, 30*a*, and 30*b* folded closed and sealed as desired. By providing a width for each of the major flaps 26*a* through 28*b* equal to one half that of the minor panels 16*a* through 18*b*, the major flaps 26*a* through 28*b* may provide for complete closure of the assembled case 1 and any contents therein.

Figure 4:
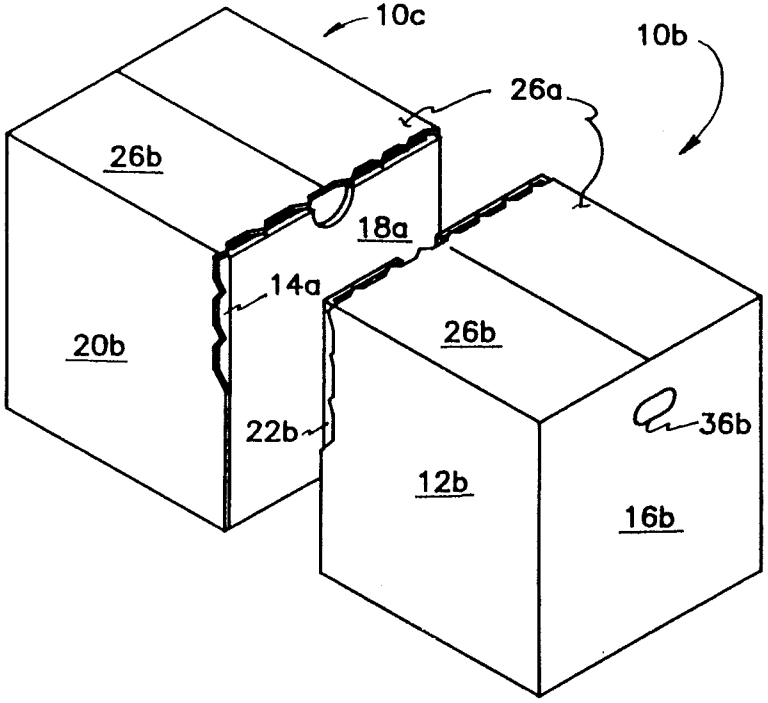
FIG. 4 is a perspective view of the separated identical first and second cartons used to form the case of FIG. 3.

The resulting case 1 assembled from cartons 10*a* and 10*b* is shown in FIG. 3. Such a case 1 provides for convenient carriage and storage of relatively large quantities of goods contained therein, while also providing for ease of separation into two equally sized separated cartons 10*c* and 10*d*, as shown in FIG. 4. The case 1 may be easily separated into two separated cartons 10*c* and 10*d* by means of the two tear strips 38*a* and 38*b* (the ends of which are shown lifted in FIG. 3), thus removing over one half of the structure securing the two cartons 10*a* and 10*b* together to form a case 1. The score lines 40*a* and 40*b* then provide for the further separation of the case 1 into the two separated cartons 10*c* and 10*d*, as shown in FIG. 4.

Each of the separated cartons 10*c* and 10*d* respectively comprises the various components which are comprised of the cartons 10*a* and 10*b* of FIGS. 1 and 2. However, the first major panel extension 20*a* originally of carton 10*a* will remain secured to the second major panel 14*b* of carton 10*b*, and the first major panel extension 20*b* originally of carton 10*b* will remain secured to the second major panel 14*a* of carton 10*a*, in a like manner. Similarly, the portion of the major flap 26*a* extending from the first major panel extension 20*a* will remain attached to the extension 20*a*, and therefore to carton 10*b* to form a separated carton 10*d*, while the major flap portion 26*b* will remain attached to the extension 20*b* and therefore to carton 10*a* to form a separated carton 10*c*. The result is two sturdy containers 10*c*/10*d* each defined by four sides 12*a*/*b* through 18*a*/*b* and having a second panel 20*a*/*b* secured to and overlying the first major panel 12*a*/*b*, with half portions of the upper major flaps 26*a*/*b* providing top closure.

Each of the above described separated containers 10*c* and 10*d* may then be sold or handled separately, as required for an individual user or consumer. The case 1, with its uniformly flat and coplanar side, top and bottom surfaces, provides easy stackability and storage for such cases 1, through the elimination of any protruding bulges due to external cardboard seams or joints. The same is also true of the individual cartons 10*c* and 10*d* after dividing the case 1 by means of the flush tear strips 38*a* and 38*b* and score lines 40*a* and 40*b*. The provision of two upper major and two upper minor flaps results in a case 1 which is easily closed using conventional case or box packaging machinery, without need for customized machinery to handle additional closure flaps as in the case of other combination boxes and the like.

The tear strips 38*a* and 38*b* and score lines 40*a* and 40*b* providing for the separation of the case 1 into the two separated cartons 10*c* and 10*d*, serve to preclude significant damage to the outer surfaces and any graphics thereon of the cartons 10*c* and 10*d*, as would be caused by the tearing removal of tape used to secure such cartons together. Thus, the present invention provides a case 1 formed by two identical cartons 10*a* and 10*b*, which provides for ease of manufacture and storage, yet further provides for ease of separation into convenient units for further sales or use. It will be further seen that the major panel extensions may be adjusted in length to be equal to relatively longer and shorter second major sides of unequal first and second cartons, if so desired, to provide first and second cartons of unequal volume and/or trapezoidal shape without deviating from a case having smooth sides which are devoid of protrusions, and constructed therefrom. Finally, although the present novel construction has been disclosed only in combination with the upper flaps of the cartons and case, it will be understood that the same novel construction may be applied equally well to the lower flaps of such cartons and resulting case, if desired.

It is to be understood that the present invention is not limited to the sole embodiment described above, but encompasses any and all embodiments within the scope of the following claims.

I claim:

1. A separable, modular container for general purpose use, comprising:

a case formed of a first carton and a second carton joined together, with said first carton and said second carton each formed from a single sheet of planar material;

said first carton and said second carton each having a first and a second major panel, a first and a second minor panel, and an attachment strip, with said first major panel of said first carton having a panel extension equal in length to the length of said second major panel of said second carton, and said first major panel of said second carton having a panel extension equal in length to the length of said second major panel of said first carton;

each said first major panel and panel extension having an upper major flap extending therefrom, with each said upper major flap being equal in length to a combined span of said each said first major panel and panel extension;

each said first major panel further having a lower major flap extending therefrom, with each said lower major flap having a length equal to the span of said each said first major panel;

each said second major panel and second minor panel respectively having a second lower major and second lower minor flap extending therefrom, with each said lower flap of each said carton providing lower closure means for said each said carton, and each said first minor panel having an upper and a lower minor flap extending therefrom;

said each said first major panel and first minor panel, and each said second major panel and second minor panel, of said first carton and said second carton each being formed into a closed structure with said attachment strip of said first carton and said second carton each being secured respectively to said first major panel and said first major panel extension of said first carton and said second carton, along a juncture thereof;

said first carton and said second carton being secured together by means of said first major panel extension of said first carton attaching to said second major panel of said second carton, and said first major panel extension of said second carton attaching to said second major panel of said first carton, with each said second minor side panel of said first carton and said second carton being disposed immediately adjacent one another and unsecured to one another;

said case having a first and a second major side and a first and a second minor side, with each said side being substantially flat and devoid of protrusions thereon, whereby;

said case is closeable using standard packaging machinery, by means of four upper flaps comprising said upper major flap and said upper minor flap respectively of said first carton and said second carton, and further by said lower closure means respectively of each said first carton and said second carton, with said upper major and lower major flaps respectively being coplanar when closed, and said case is efficiently storable and stackable by means of each said substantially flat side of said case and closed coplanar said upper and said lower flaps.

2. The separable, modular container of claim 1 wherein:

said each said first major panel extension is equal in length to said each said first major panel.

3. The separable, modular container of claim 1 wherein:

each said closed structure of said first carton and said second carton is substantially rectangular.

4. The separable, modular container of claim 1 wherein:

said first carton is equal in size to said second carton.

5. The separable, modular container of claim 1 including:

means providing for the separation of said case into said separated first and second carton.

6. The separable, modular container of claim 5, wherein:

said separation means comprises a tear strip across each said upper major flap and extending downward substantially halfway across said each said first major panel and said each said panel extension along a juncture thereof, and a score line extending respectively from each said tear strip and continuing across said each said first major panel and said each said panel extension, whereby;

each said tear strip is removed and said case is separated into said separated first carton and second carton by means of each said score line.

7. The separable, modular container of claim 1 wherein:

each said attachment strip is adhesively secured respectively to said first major panel and said first major panel extension of said first carton and said second carton.

8. The separable, modular container of claim 1 wherein:

said first carton and said second carton each include partitions therein providing for the storage of separate articles therewithin.

9. The separable, modular container of claim 1 including:

hand hold means disposed in at least said each said first minor panel of said first carton and said second carton.

10. The separable, modular container of claim 1 wherein:

said case comprising said first carton and said second carton are formed of fiberboard material.

11. The separable, modular container of claim 1 wherein:

said case comprising said first carton and said second carton are formed of corrugated fiberboard material.

* * * * *